United States Patent [19]

Gates

[11] 4,218,039

[45] Aug. 19, 1980

[54] CONCRETE FORM TIE

[75] Inventor: H. Gordon Gates, Denver, Colo.

[73] Assignee: Gates & Sons, Inc., Denver, Colo.

[21] Appl. No.: 8,788

[22] Filed: Feb. 1, 1979

[51] Int. Cl.[2] ..... E04G 17/08

[52] U.S. Cl. ..... 249/214; 249/38; 249/41; 249/43; 249/190; 249/217; 264/271; 264/342 R

[58] Field of Search ..... 249/213, 214, 215, 216, 249/217, 38, 41, 43, 190, 191; 264/342, 271, 272, 234

[56] References Cited

U.S. PATENT DOCUMENTS

| | | | |
|---|---|---|---|
| 1,479,936 | 1/1924 | Stevens | 264/342 |
| 3,139,730 | 7/1964 | Williams et al. | 249/213 |
| 3,465,999 | 9/1969 | Gates | 249/213 |
| 3,612,473 | 10/1971 | Franklin | 249/213 |
| 4,159,097 | 6/1979 | Strickland | 249/213 |

*Primary Examiner*—Donald J. Arnold

*Attorney, Agent, or Firm*—Sheridan, Ross, Fields & McIntosh

[57] ABSTRACT

A form tie and a method of making the same is provided. The form tie includes an elongated hollow protective sleeve contiguously surrounding a portion of the form tie to facilitate the removal of the form tie portion from a settable casting, such as concrete. The thickness of the sleeve is minimized so that the cross-sectional area of the form tie portion which includes the surrounding sleeve is also minimized.

9 Claims, 13 Drawing Figures

22
20
26
24
26
22

26
30
32
24
28

26
28
24

26
28
C
24

7
28
8
7
26
8

24
22

26
30
32
28

32
30
26
24

W
26
28
22

CONCRETE FORM TIE

DESCRIPTION

Technical Field

This invention relates to concrete form ties placed between a pair of spaced form panels and, in particular, to a concrete form tie having a hollow plastic tube surrounding each of the ends thereof to facilitate the removal of a portion of the form tie after the concrete hardens.

BACKGROUND ART

Various concrete form ties are available for use in supporting concrete form panels so that ends of the form ties may be severed after the concrete sets or hardens. The cavities left in the concrete due to the portions of the form tie removed therefrom are then patched with suitable materials. One particular concrete form tie assembly is disclosed in my U.S. Pat. No. 3,437,306 which issued on Apr. 8, 1964 and is entitled "Concrete Form Tie Assembly And Plug Therefor". Although the frusto-conical plug provided adjacent the end of the form tie described in the above-identified patent adequently serves its intended purposes, there are certain concrete forming applications in which this form tie is not suitable. On occasion, it is desirable to leave a relatively small cavity after the end portion of the form tie has been removed. Additionally, the use of the frusto-conical plug is not suitable in those concrete forming applications in which a particular welded steel frame is used to reinforce the concrete form panels, as is more fully described in my U.S. Pat. application Ser. No. 887,441, filed on Mar. 20, 1978 and entitled "Clamping Lock For Looped Ties" because of the relatively small aperture through which the form tie must be inserted. Since some type of device or material must be placed on the portion of the form tie that is to be separated and removed from the hardened concrete so that it is easily removed therefrom, some solutions to the problem of leaving only relatively small cavities in the concrete have been devised. Conventional grease substances have been applied to the ends of the form ties. However, it has been found that, after removal of the greased form tie end, some grease remains in the concrete and when the cavity is filled with a plug or patch the grease prevents adequate sealing of the patched concrete. Different kinds of paint coatings have also been applied to the form tie ends. Again, a number of problems arose because of the use of paint. Often times the paint hardens in such a manner that it becomes substantially an integral part of the form tie so that the lubricating action of the form tie end is lost. Thus, when the end of the form tie is severed, there is considerable difficulty in removing this end because it adheres to the hardened concrete. Another problem observed with the use of some types of paints is that they dry too slowly on the form tie. This slow drying time is very undesirable since it is often necessary to make the form ties and have them immediately ready for use. Still another problem encountered is that the paint does not dry completely and the form tie may stick to another substance with which it contacts. This problem is particularly acute when such form ties are placed together in a container. Upon removal from the container, the form ties may have to be forceably separated. This procedure results in the removal of the paint coating from the form tie end portion and renders the form tie unusuable, inasmuch as its purpose is to facilitate the removal of the form tie end from the concrete, since the lubricating action of the paint is not available.

Thus, the form tie of this invention alleviates the above-noted problems with the addition of a sleeve which quickly and efficiently attaches to the end portion of the form tie which is to be broken back or detached. The sleeve containing portion of the form tie is easily removed from the hardened concrete after is it severed from the remaining body of the form tie. In addition, the thickness of the sleeve minimally increases the cross-section of the form tie so that a relatively small cavity remains in the concrete after the end of the form tie has been broken away and removed from the concrete.

DISCLOSURE OF INVENTION

In accordance with the present invention, a form tie and methods of making the same are provided. The form tie includes a shank having a pair of integrally formed loop ends. Inwardly adjacent each of the form tie ends is an elongated hollow sleeve which contiguously surrounds a portion of the form tie. Integrally formed between each of the sleeves and the shank is a relatively flat, weakened portion of substantially less strength than the remaining portions of the form tie so that rotational or twisting forces applied thereto will sever the form tie ends from the shank at the weakened portion.

More particularly, a form tie is provided for concrete forming applications which require a break back protective device that minimally increases the size of the portion of the form tie that is to be detached. The form tie includes an elongated shank placed between a pair of concrete forming panels. At each end of the shank is an elongated loop which extends through a slot in each of the form panels. Conveniently, a form tie clamp or clamping lock engages each of the looped ends. The clamping lock in combination with reinforcing members and the form tie maintains the concrete forming panels in spaced relation while concrete is poured therebetween. A hollow, elongated sleeve or break back protective device contiguously surrounds the outer surfaces of portions of the form tie which are inwardly adjacent each of the elongated loops thereof. A portion of the sleeve extends beyond the outer surface or face of each of the form panels while the remaining sleeve portion extends inwardly along a portion of the shank from the inner surface or face of the form panels to a break back point. A break member or weakened portion is provided at this break back point which is integrally formed between each of the sleeve containing portions of the form tie and the shank of the form tie. After the setting of the concrete, rotational or twisting forces may be applied to the elongated loop. These forces cause the break member to bend and subsequently break thereby severing the elongated loop and sleeve containing form tie portion from the shank. Since the sleeve is made of a material, such as plastic, to which the concrete does not readily adhere, the broken form tie portion is easily removed from the hardened concrete. The resulting cavity in the concrete may then be filled with a suitable patching material.

To secure the protective break back device or sleeve on the form tie, an elongated shank with the integrally formed break members near each shank end is initially provided. A generally cylindrical hollow sleeve made of a heat shrinking material is fitted over the outer surface of a portion of the shank near each of the break members. Heat is applied to the sleeve resulting in its shrinking so that it contiguously and tightly surrounds the form tie portion. The heat for shrinking the sleeve may be supplied by conduction through the form tie when the ends of the form tie are heat welded to form the elongated looped ends. Alternatively, heat may be supplied from an outside source, such as a heat lamp.

From the foregoing, it can be appreciated that a form tie having a break back protective device is provided which leaves a relatively small cavity in the concrete formation and is highly suitable in concrete applications in which a relatively large sized break back protective device or release device, such as a cone-shaped plug, is inappropriate. Additional advantages of this invention will be readily apparent taken in conjunction with the accompanying drawings.

BEST MODE FOR CARRYING OUT THE INVENTION

Figures 1, 2, 3, 4, 5, 6, 7, 8, 9:
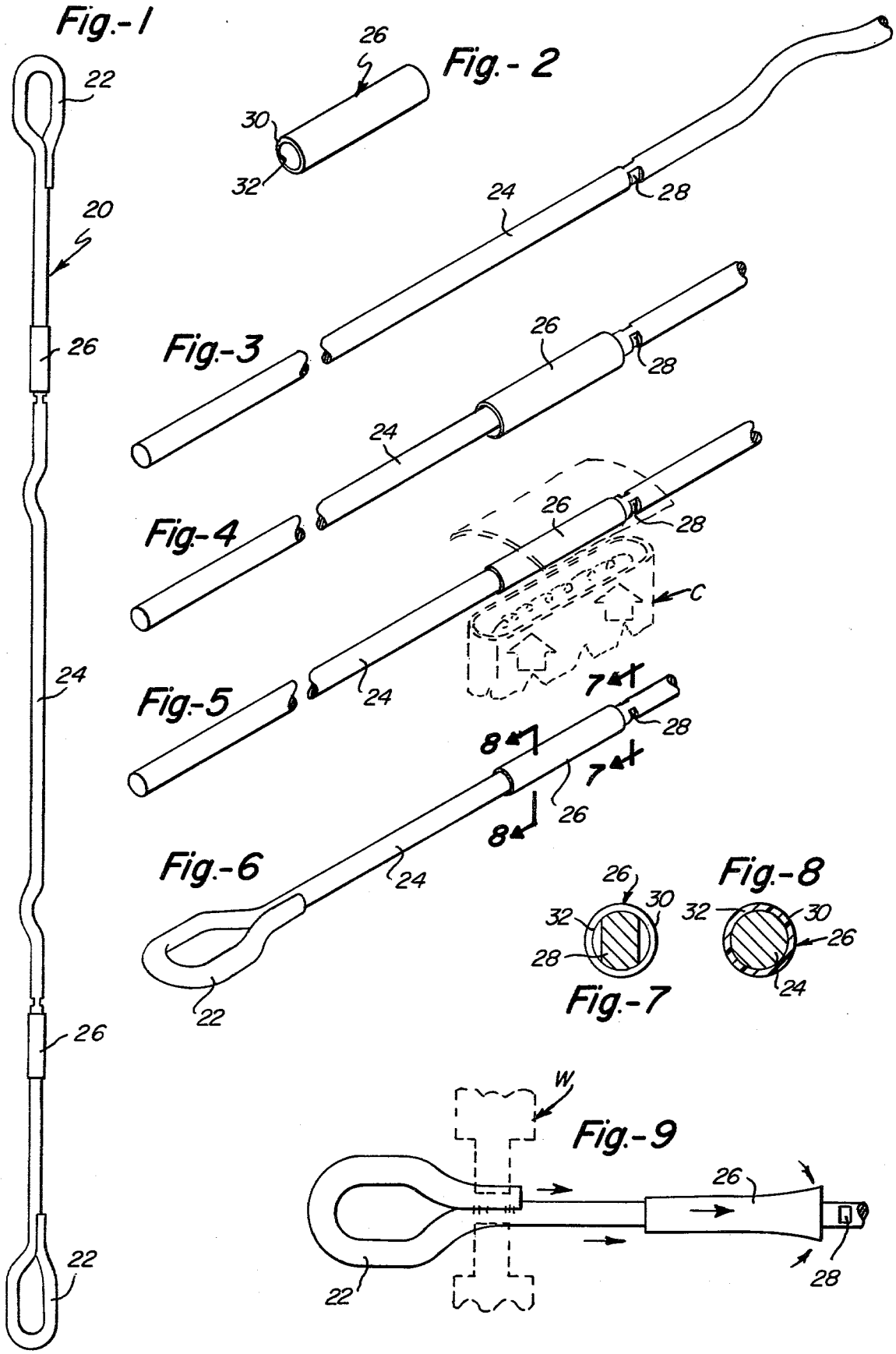
FIG. 1 is an elevational view of a looped form tie showing a pair of break back protectors surrounding portions of the form tie.
FIG. 2 is a perspective view of the break back protector.
FIG. 3 is a perspective view of the form tie with a portion cut away and showing a break member adjacent one end of the form tie.
FIG. 4 is a perspective view of the form tie, similar to FIG. 3, but showing the break back protector placed over a portion of the form tie just outwardly of the break member.
FIG. 5 is a perspective view of the form tie, similar to FIG. 4, but showing the application of heat to the sleeve.
FIG. 6 is a perspective view of the form tie, similar to FIG. 4, but showing the form tie with a looped end and with the break back protector contiguously surrounding a portion of the form tie.
FIG. 7 is an enlarged vertical section, taken along line 7—7 of FIG. 6, showing a cross section of the break back protector and the break member.
FIG. 8 is a vertical section, taken along line 8—8 of FIG. 6, showing the thickness of the break back protector as it surrounds the form tie.
FIG. 9 is a fragmentary, side elevational view of a form tie illustrating the movement of heat from a heat source to the break back protector to cause the protector to shrink.

Referring to the drawings, FIG. 1 shows a supporting tool or form tie 20 having a pair of generally elongated looped ends 22. A shank or rod 24 integrally connects the looped ends 22 to form a conventional form tie. A break back protective member 26, such as a sleeve as depicted in FIG. 2, is positioned adjacent each of the form tie looped ends 22. Sleeve 26 is a hollow elongated tube which surrounds a portion of the outer surface of the form tie 20. A pair of break members or weakened portions 28 are integrally formed in the shank 24 near each end of the form tie 20. The break members 28 are generally notches or indentations formed in the shank 24 of the form tie 20.

The operation of placing the sleeve 26 over a portion of the form tie 20 is illustrated in FIGS. 3–6. Initially, a form tie 20 is provided, shown in fragmented sections in FIG. 3, having a break member 28. The sleeve 26, when placed over a portion of form tie 20 adjacent break member 28 as illustrated in FIG. 4, has an inner diameter greater than the diameter of shank 24 so that sleeve 26 easily moves into the desired position. Sleeve 26 is made of a material that shrinks or reduces in size when heat is applied thereto. Plastic heat shrinking tube material has been used in such areas as electrical wiring where it is desirable to hold in juxtaposed relation a number of insulated conductor wires. As illustrated in FIG. 5, the application of heat to sleeve 26 by a conventional heated coil C causes the sleeve 26 to shrink so that it contiguously surrounds a portion of form tie 20. The adhering or contacting of sleeve 26 against the outer surface of shank 34 is best depicted in FIGS. 7 and 8. After a proper heating application, the sleeve 26 remains uniform throughout its outer or first surface 30 while the inner or second surface 32 uniformly adheres to the shank 24 with no gaps formed between the outer surface of the shank 24 and the inner surface 32 of the sleeve 26. This contiguous relation minimizes the increase in the cross-sectional area of the form tie portion containing the sleeve 26. Also, sleeve 26 is selected to be of a very thin material or, in other words, the distance between inner surface 32 and outer surface 30 is substantially smaller than the thickness of form tie 20. This feature further minimizes the increase in the cross-sectional area of the form tie 20 because of the addition of sleeve 26. Such a feature is desirable in certain concrete-forming operations to be explained more fully later.

Another method of reducing the sleeve 26 to contiguously surround a portion of the form tie 20 is illustrated in FIG. 9. When the ends of the form tie 20 of FIG. 3 are to be formed in a loop, the ends are first bent inwardly toward the shank 24 until an elongated loop is formed by the contacting of portions of the form tie 20. To securely hold the looped end 22, a conventional heat weld unit W is utilized to fixedly join the contacting portions of the form tie 20. The heat emitted by the welding operation in close proximity to the sleeve containing form tie portion is transmitted by conduction along shank 24 to the sleeve 26 so that it shrinks or reduces in size and, as noted previously, uniformily and contiguously surrounds the form tie 20. The heat is transmitted such that the shrinking of the sleeve 26 occurs along a generally longitudinal path from an end portion of sleeve 26 adjacent a looped end 22 to the opposite end portion of sleeve 26 which is adjacent the break member 28.

Figure 10:
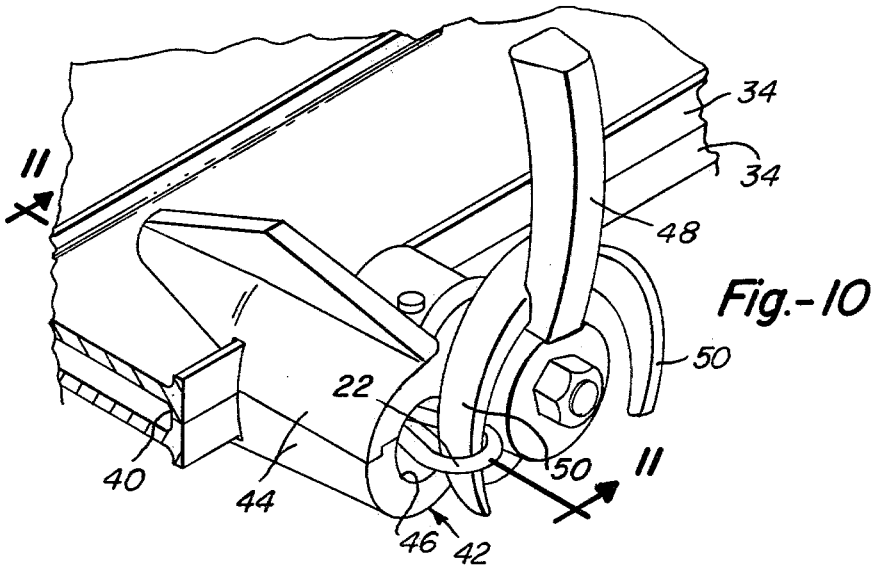
FIG. 10 is a perspective view illustrating one application of the form tie of this invention and showing a portion of a casting form having a pair of joined flanges and a clamping lock for holding the form tie.
Figure 11:
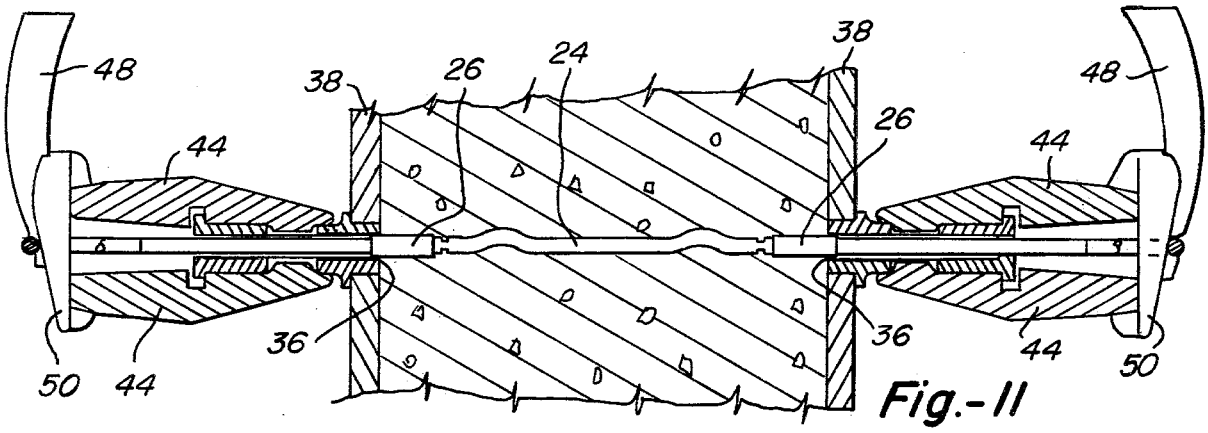
FIG. 11 is a longitudinal section, taken along lines 11—11 of FIG. 10, showing the form tie of this invention with a pair of spaced concrete containing form panels and the clamping lock of FIG. 10 adjacent each form panel.
Figure 12:
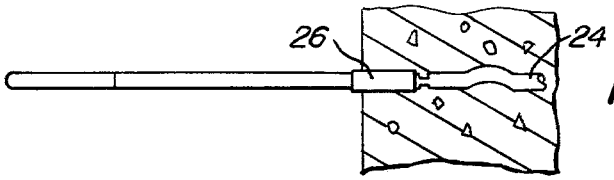
FIG. 12 is a fragmentary view of the form tie inserted through a slot in the form panel with a portion of the break back protector extending outwardly of the concrete.
Figure 13:
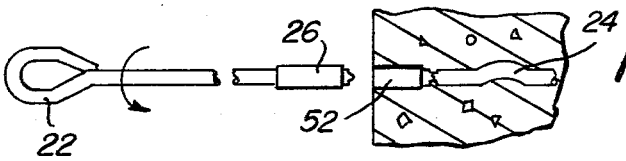
FIG. 13 is a fragmentary view of the form tie detached at the break member and removed from the concrete.

Form tie 20 with sleeves 26 is particularly suited for concrete forming operations which utilize a relatively small slot formed in the concrete forming panels or where the clamping lock and walers which reinforce the form panels include relatively small apertures through which the form tie must pass. An example of the latter is illustrated in FIGS. 10 and 11. A pair of aligned engaging flanges 34 are inserted in each of two slots 36 formed in a pair of form panels 38. The slots 36 are relatively small in size so that the space 40 between the flanges 34 is minimized. The flanges 34 together with the form tie 20 support the form panels 38 while concrete is poured and hardens therebetween. A clamping lock 42, particularly suited for use with the flanges 34, grips the looped ends 22 to maintain the fixed relation of the form tie 20 with respect to the form panels 38. Clamping lock 42 is described in detail in applicant's co-pending U.S. Pat. application Ser. No. 887,941 filed Mar. 20, 1978 and entitled "Clamping Lock For Looped Ties" and includes a pair of clamping members 44 which grippingly connect to the flanges 34 extending outwardly from the form panels 38. An opening 46 is provided between the clamping members 44 through which the looped end 22 of the form tie 20 passes to be grippingly engaged by an anchor lock 48 having a pair of arms 50. One of the arms 50 is rotatably moved through the looped end 22 to secure the position of the form tie 20 between the form panels 38 while the concrete sets. As depicted in FIG. 12, once the concrete hardens the form panels 38 may be removed as well as the clamping locks 42 and the flanges 34. The form tie 20 remains supported by the hardened concrete with a portion of the sleeve 26 extending outwardly of the set concrete. To remove the portion of the form tie outwardly disposed with respect to the concrete, the looped end 22 is rotated or twisted. This rotational movement applies a force to the break member 28 which causes it to split along an axis generally perpendicular to the longitudinal axis of the form tie 20. After this breaking operation the portion of the form tie 20 which is broken back is readily removed from the hardened concrete since the sleeve 26 protects the underlying form tie portion from adhering to the hardened concrete. Additionally, since the sleeve 26 fixedly and contiguously contacts the outer surface 30 of the portion of the form tie 20 which is severed or broken back of the break member 28, it is also removed together with the broken back form tie portion. If, however, the sleeve 26 should remain in the concrete after removal of the broken portion of the form tie, it is a simple task to grip that portion of the sleeve 26 which extends outwardly beyond the concrete and pull the sleeve therefrom. Thus, positioning a portion of the sleeve 26 outwardly beyond the slots 36 of the form panels 38 provides additional assurance that the sleeve 26 will not remain in cavity 52 after the form tie breaking operation. Also seen in FIG. 13, the cavity 52 remaining in the concrete after removal of the sleeve surrounding form tie portion is of substantially the same thickness or cross-sectional area as the thickness of the form tie 20 itself. Thus, the cavity 52 which must be filled or patched with conventional materials is minimized.

Accordingly, a form tie for use in particular concrete forming operations is provided. When it is desirable that the size of the break back protector be minimized while still providing the necessary concrete non-adhering feature, the form tie disclosed herein may be utilized. When it is not feasible to use a relatively large break back protector because of the particular panel reinforcing members and form tie clamping locks, the form tie and break back protector disclosed herein may be utilized. Furthermore, since the plastic sleeve is removed in its entirety, the remaining cavity does not have any foreign materials in it. Thus, a good bond between the patching compound used to fill the cavity and the surrounding concrete can be expected.

The invention has been described in detail with reference to a particular embodiment and method of making the same, but it will be understood that variations and modifications can be affected within the spirit and scope of this invention.

I claim:

1. A form tie for supporting a pair of spaced form panels which contain a settable composition therebetween, each form panel having a relatively small slot formed therein for receiving one end portion of the form tie therethrough, said form tie comprising:

an elongated shank insertable between the form panels;

a pair of form tie ends integrally connected to said shank for projecting outwardly of the form panels;

a pair of break members integral with said shank and located along said shank so as to be inwardly of the form panels, said members having a thickness less than the thickness of said shank so that a rotational force applied to each of said form tie ends results in the breaking of the form tie at each of said break members after the composition is set; and a pair of hollow, heat shrinkable, solidly formed break back protective sleeves each having relatively thin side walls for contiguously surrounding and tightly engaging portions of said shank inwardly of the form panels, each of said break back protective members being positioned between one of said form tie ends and one of said break members and shrunk into place by heating so that after the composition between the form panels sets, said break members can be split and the form tie portions, including said break back protective sleeves, can be easily removed from the settable composition, the thickness of each of said break back protective members being substantially smaller than the thickness of the shank.

2. The form tie, as claimed in claim 1, wherein:

a portion of each of said break back protective sleeves extends toward said form tie ends a sufficient distance so as to be positioned outwardly of the settable composition and tightly engaging said portions of said shanks so that said sleeves are removed with the respective form tie ends.

3. The form tie, as claimed in claim 1, wherein:

said break back protective member is an elongated generally cylindrical thin walled sleeve of substantially uniform thickness.

4. A form tie for supporting a pair of spaced form panels which contain a settable composition therebetween, each form panel having a relatively small slot formed therein for receiving one end portion of the form tie therethrough, said form tie comprising:

an elongated shank insertable between the form panels;

a pair of form tie ends each having an elongated loop integrally connected at opposite end portions of said shank;

a pair of break members, each having a smaller cross-sectional size then the cross-sectional size of said shank and integrally formed in said shank inwardly of each of said looped form tie ends and positionable inwardly of the form panels so that a rotational force applied to each of said form tie ends results in the breaking of the form tie at each of said break members; and a pair of heat shrinkable, hollow, generally cylindrical sleeves, each of said sleeves contiguously and uniformally and tightly surrounding a portion of said shank between each of said looped form tie ends and each of said break members, the thickness of each of said sleeves being substantially smaller than the thickness of said shank.

5. A method of making a form tie having a protective break back member for use with forming panels having a settable composition contained therebetween and in which the size of the slots through which the end portions of the form tie extend are relatively small and the cross-sectional area of the portion of the form tie containing the protective break back member is minimized, said method comprising the steps of:

providing a form tie having an elongated shank and a pair of opposing ends with a break member integrally formed in said shank inwardly of each of said form tie ends;

placing a hollow, heat shrinkable break back protective sleeve over a portion of the outer surface of said shank but outwardly of said break member; and heating said protective break back sleeve so that it is reduced in size to contiguously and tightly surround the outer surface of said shank.

6. The method, as claimed in claim 5, wherein:

said break back protective member is of a thickness substantially less than the thickness of said shank.

7. The method, as claimed in claim 5, wherein said break back protective member is a cylindrical sleeve of substantially uniform thickness.

8. A method of making a form tie having a protective break back member for use with forming panels having a settable composition contained therebetween and in which the size of the slots through which the end portions of the form tie extend are relatively small and the cross-sectional area of the portions of the form tie containing the protective break back member is minimized, said method comprising the steps of:

providing a form tie having an elongated shank and a pair of opposing ends with a break member integrally formed in said shank inwardly of each of said form tie ends;

placing a hollow, heat shrinkable break back protective member over a portion of the outer surface of said shank but outwardly of said break members;

bending said ends of said form tie so that said ends contact said shank outwardly of said break member to form elongated loops at opposing ends of the form tie;

heating the area of contact of the form tie ends to weld the ends of the form tie to said shank at the area of contact; and transmitting the heat applied to said form tie ends by conduction along said shank to said break back protective member to shrink the break back protective member in size so that it contiguously and tightly surrounds the outer surface of a portion of said shank.

9. The method, as claimed in claim 8, wherein:

said break back protective member shrinks substantially along a longitudinal path from an end portion of the break back protective member adjacent the looped form tie end to an end portion of the break back protective member adjacent said break member.

* * * * *